United States Patent [19]

LeVeau

[11] 4,434,567

[45] Mar. 6, 1984

[54] MEMORABILIA REPOSITORY

[75] Inventor: Robert LeVeau, Overland Park, Kans.

[73] Assignee: Hallmark Cards, Inc., Kansas City, Mo.

[21] Appl. No.: 369,982

[22] Filed: Apr. 19, 1982

[51] Int. Cl.[3] ..... B42D 3/12

[52] U.S. Cl. ..... 40/157; 281/31; 434/309; 206/473; 84/94 C

[58] Field of Search ..... 40/152, 157, 455, 457, 40/906; 46/175 AR; 84/94 C; 434/309, 317; 206/472, 473; 281/31

[56] References Cited

U.S. PATENT DOCUMENTS

| | | | |
|---|---|---|---|
| 428,795 | 5/1890 | von Auw | 84/94 C X |
| 3,172,687 | 3/1965 | Lawrence | 281/31 |
| 3,798,806 | 3/1974 | Sanford | 40/455 |
| 4,001,960 | 1/1977 | Holson | 40/159 |
| 4,004,689 | 1/1977 | Glasell | 434/317 X |
| 4,164,085 | 8/1979 | Steeb et al. | 40/152 |

*Primary Examiner*—Robert P. Swiatek

*Attorney, Agent, or Firm*—Neuman, Williams, Anderson & Olson

[57] ABSTRACT

A repository for memorabilia which affords visual and auditory sensations.

6 Claims, 9 Drawing Figures

MEMORABILIA REPOSITORY

This invention relates to a repository for memorabilia which affords visual and auditory sensations.

BACKGROUND OF THE INVENTION

The practice of maintaining scrapbooks or albums in which there are deposited keepsakes such as letters, clippings and photographs is widely practiced. Many people maintain an album in which are retained such momentos which they value for one reason or another. Very often albums are maintained which include a collection of photographs having particular sentimental value to the owner of the album. Upon reviewing such an album, memories of persons, events or places shown in the album are refreshed. The enjoyment attending reminiscence of the album contents can often be enhanced by simultaneously hearing a musical composition or song which has particular relevance to all or some of the memorabilia retained in the album.

SUMMARY OF THE INVENTION

It is therefore an object of this invention to provide a repository for memorabilia which affords both visual and auditory sensations.

It is another object of this invention to provide an album such as a photo album having associated therewith a music box which becomes operative when the album cover is opened.

It is another object of this invention to provide a keepsake album having associated therewith a music box which emits sounds to heighten the enjoyment of one viewing the album contents.

It is a further object of the invnetion to provide a keepsake album having associated therewith a device to emit music or song selected for sentimental value in relation to momentos retained in the album.

This invention provides a repository for memorabilia such as clippings, photographs, letters and like keepsakes which, when in use, emits sound permitting the viewer to visually inspect the contents of the repository and enjoy concurrently a musical composition or song.

In accordance with a presently preferred embodiment of the invention an album adapted for retaining visual memorabilia such as photographs is provided having as an integral part thereof a music box of conventional type. The music box is associated with the album in such manner that upon opening of the album cover the music box becomes operative to emit sound which can comprise a song or musical composition.

The particular advantages and full nature of a preferred embodiment of the invention will be understood from the accompanying drawings and the following disclosure and claims.

DESCRIPTION OF THE PREFERRED EMBODIMENT

Figure 1:
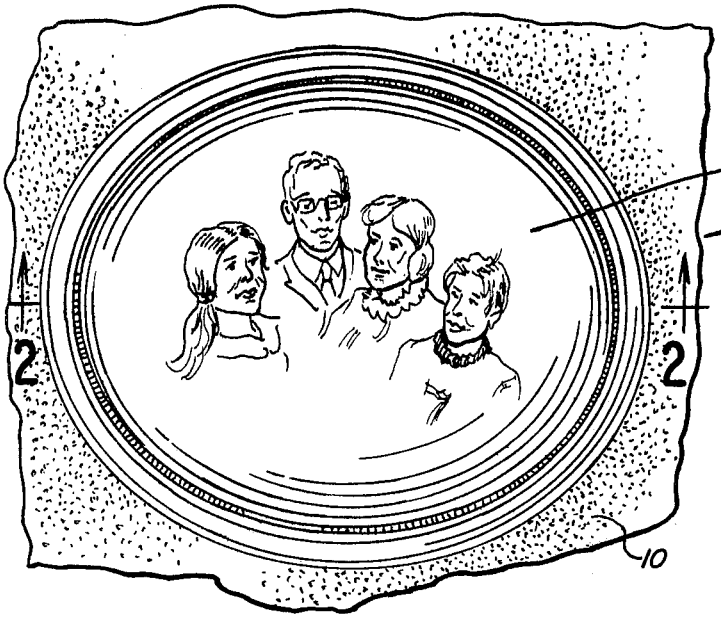
FIG. 1 is a plan view of an album cover partially shown having associated therewith sound emitting means in accordance with the invention.
Figure 5:
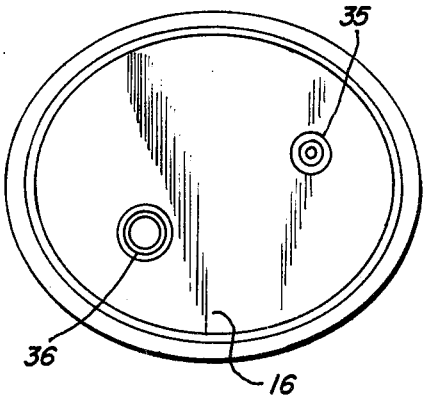
FIG. 5 is a view of the bottom element which forms the housing for retaining a sound emitting device within an album cover.
Figure 2:
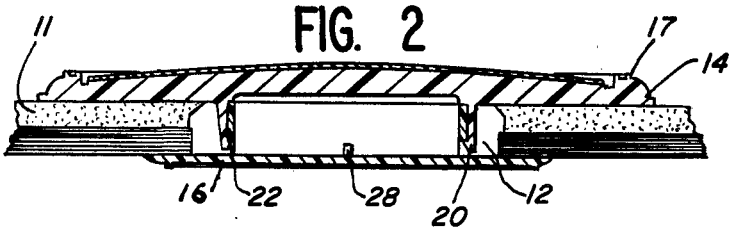
FIG. 2 is a sectional view of the album cover of FIG. 1 taken on line 2—2 thereof.
Figure 3:
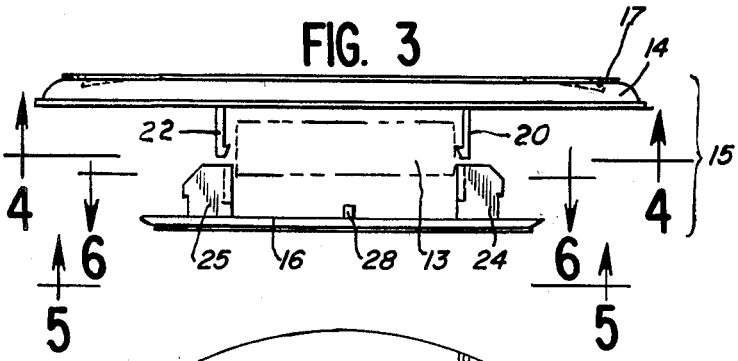
FIG. 3 is an elevational view showing in nonengaged position the elements which form a housing for retaining a sound emitting device within the album cover.
Figure 6:
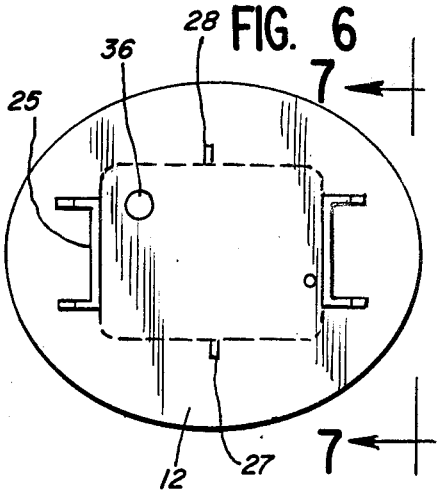
FIG. 6 is a view of the bottom housing-forming element taken on the line 6—6 of FIG. 3.
Figure 4:
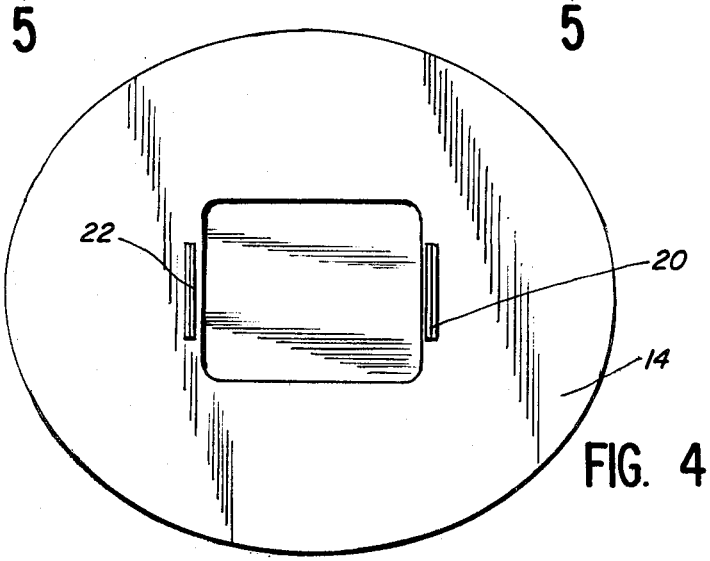
FIG. 4 is a bottom view of the top housing-forming element taken on the line 4—4 of FIG. 3.
Figure 7:
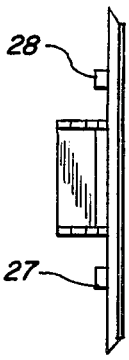
FIG. 7 is a view of the bottom housing-forming element taken on the line 7—7 of FIG. 6.
Figure 8:
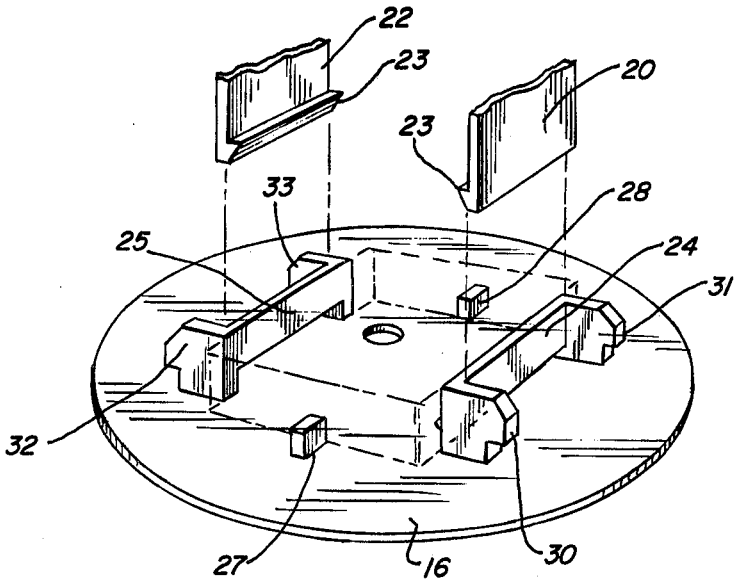
FIG. 8 is a fragmentary exploded view in perspective showing means for joining the top and bottom elements which form the housing for the sound emitting device.

Referring more specifically to the drawings, numeral 8 designates generally an album of conventional type used to maintain a collection of photographs, letters, clippings or similar memorabilia. The album 8 can be of conventional design, including front and back covers, a spine and a plurality of pages secured within the covers. The album pages are attached to the spine in known manner, such as by means of a ring mechanism. The album includes a front cover 10 adapted for movement between an open and closed position and this cover can be fabricated from a variety of relatively rigid materials as is known, such as paperboard, plastics, laminates and the like. More elegant album covers are of the padded type having a layer of a resilient material 11, such as foam, covering a backing member and having an overlay of vinyl or leather or simulated leather. Sound emitting devices can be incorporated as disclosed herein in any type of known album covers.

In accordance with this invention, the album cover 10 is cut out, preferably in the central portion, using a die or other suitable means, to provide an opening 12 for insertion of a music emitting device such as a conventional music box 13. Small, relatively thin music boxes of the electronic or mechanical wind-up type are well kniown and the music box employed herein is not per se an essential feature of the invention. It is preferred to employ a music box of the type which is activated and deactivated by means of a movable stopper which when restrained in the "off" position renders the music box inoperative, but when released moves to the "on" position to render the music box operative. Representative of suitable preferred music boxes are the Sankyo 18M series having dimensions of approximately $1.13 \times 1.46 \times 0.41$ inches. Such music boxes are well known to the art and accordingly wlll not be described in detail. The music box can be one which in operation emits a song or musical composition selected for its sentimental value. The opening 12 in the front album cover can be square or rectangular in shape and is of a size sufficient to accommodate a music box and the housing therefor. For example, with a photo album having a cover 9.5 inches by 11 inches, a rectangular opening of about 1.375 by 2 inches is provided in the center of the cover.

The music box is retained in snug fit within a two-piece housing structure 15, i.e. a top housing section 14 and bottom housing section 16, which are adapted to be clamped together to form a secure protective structure for the sound emitting device and to conceal the opening in the album cover. The top and bottom housing sections are preferably fabricated of light weight, relatively rigid materials such as polystyrene, ABS Copolymer, acrylics and the like. The top section 14 comprises a generally flat member of sufficient size to overlie and completely conceal the opening 12 in the album cover. It can be of any desired configuration, it being shown in the drawings as oval shaped, and while it is generally flat, it can have a contoured convex configuration as shown for aesthetic reasons. The exterior surface of the top section 14 overlying the opening in the cover can contain a decorative design or contain desired indicia such as the identity of the owner and/or contents of the keepsake album. For example, the exterior surface of the top housing section can be provided with a circumferential slot 17 adapted to hold a photograph 18 as illustrated or other indicia. Depending downwardly from the top section so as to protrude through the opening in the cover are two spaced oppositely disposed legs 20 and 22, each having a J-shaped hook structure 23 at the distal ends thereof. The spacing of the legs 20 and 22 is such as to permit snap engagement with complementary locking elements on the bottom housing section.

The bottom housing section 16 is a generally flat member sufficiently large in size to conceal the opening in the album cover. Upstanding from bottom housing 16 are two elongated, oppositely disposed locking members 24 and 25 and two side positioning members 27 and 28. The locking members 24 and 25 and positioning members 27 and 28 are spaced so as to accommodate and retain by frictional engagement a music box of desired size. At the distal ends, the locking members are provided with outwardly projecting hook or lug portions 30, 31, 32 and 33. The housing for the music box is formed into a unitary structure clamping the album cover therebetween by engaging the J-shaped hooks 23 underneath the locking members 24 and 25. Clearance hole 36 is provided in bottom section 16 to permit protrusion from the housing of the winder for the music box. Clearance hole 35 in the bottom section permits insertion of a retaining screw to hold the music box against the bottom housing section 16.

To construct a keepsake repository or album in accordance with this invention, an opening of suitable size is first provided in the top cover of an album. The bottom section of the music box housing is then inserted into the die-cut opening from the underside of the cover. A music box is then inserted into the bottom section and held therein by frictional engagement with upstanding locking members 24 and 25 and side positioning members 27 and 28 and by a retaining screw inserted through hole 35. Thereafter, the top section of the housing is positioned to overlie the opening in the cover with the legs 20 and 22 projecting therethrough in mating position with the locking members 24 and 25 on the bottom section. The J-shaped hooks 23 on the depending legs of the top section are then snapped into fitting engagement underneath locking members 24 and 25. The top and bottom sections of the housing are thus securely joined to form a relatively tight-fitting secure enclosure or housing for the music box. It will be appreciated that the housing for the music box will be of a size sufficient to accommodate a music box of desired size. Thus, the top and bottom sections forming the music box housing and the elements thereof are suitably dimensioned to hold snugly a music box of desired size without permitting the music box to move or slide appreciably within the housing. The opening in the top cover of the album is likewise of suitable size to accommodate the housing for the music box.

Figure 9:
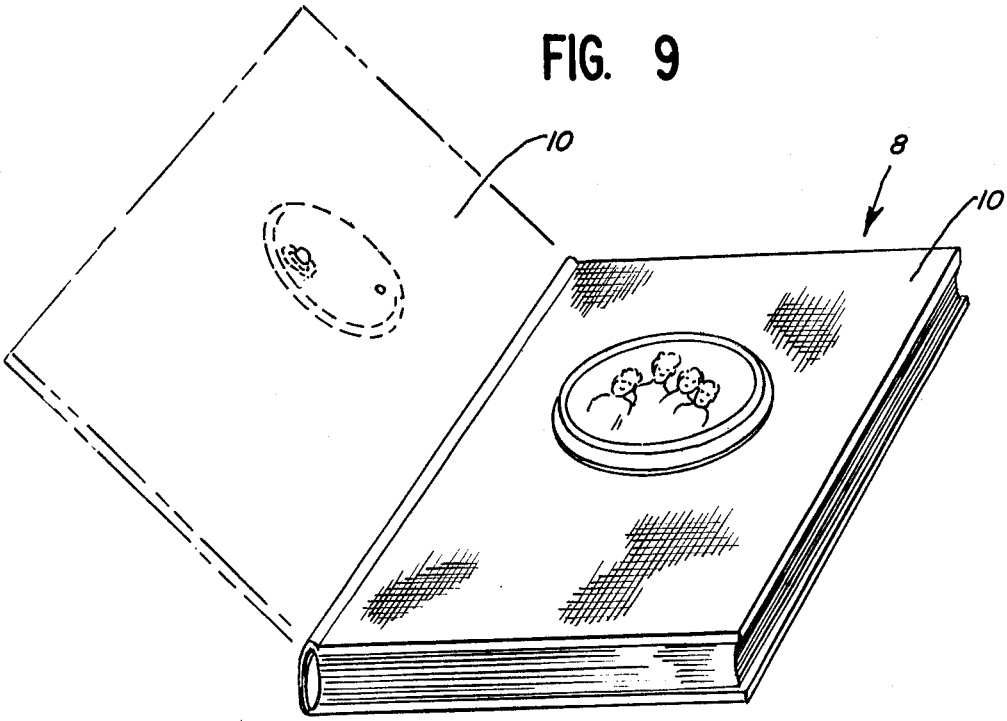
FIG. 9 is a perspective view of an album having associated therewith a sound emitting device with the album cover being shown closed in solid lines and with the album cover shown open in broken lines.

After assembly, when the album cover is in closed position as shown by the solid lines in FIG. 9, the exterior decorative top portion of the music box housing is visible, but no sound is emitted from the music box because the control stopper for the music box is held in the restrained "off" position. When the album cover is in open position as represented by the dotted lines in FIG. 9, the bottom section of the housing is visible, but not the opening in the album cover. When in this latter position, the control stopper for the music box is no longer restrained and moves to the "on" position so that sound is emitted from the music box.

Those modifications and equivalents which fall within the spirit of the invention are to be considered a part thereof.

What is claimed is:

1. A repository for memorabilia having a front cover which is movable between open and closed positions, said front cover being provided with an opening therein, a housing for a sound emitting device disposed within said opening and a sound emitting device within said housing which emits sound when the front cover is in open position, said housing being formed of top and bottom housing sections adapted for snap fit engagement with each other, said bottom housing section being a generally flat element of a size larger than the opening in the front cover and sufficient to conceal said opening and having a plurality of upstanding positioning members spaced to hold the sound emitting device by frictional engagement therewith, said top housing section being a generally flat or convex element of a size larger than the opening in the front cover sufficient to conceal said opening and having a plurality of legs therefrom adapted for snap fit engagement with said bottom section to form a unitary structure and to clamp therebetween said front cover.

2. A repository in accordance with claim 1 which is a photographic album.

3. A repository in accordance with claim 1 having a padded front cover.

4. A repository in accordance with claim 1 wherein the portion of the housing visible on the outer surface of the front cover is provided with a decorative design or indicia.

5. A repository in accordance with claim 1 wherein the sound emitting device is a music box.

6. A repository in accordance with claim 1 wherein the top and bottom sections of said housing are formed of a plastic material.

* * * * *